US005493966A

United States Patent [19]

Tseng

[11] Patent Number: 5,493,966

[45] Date of Patent: Feb. 27, 1996

[54] STAMPING MACHINE FOR PRINTING PATTERNS ON A BLIND SLAT AND A METHOD USING SUCH A MACHINE

[76] Inventor: Wen-chung Tseng, No. 268-6, Sec. 1, Hsitun Rd., 9th Lin, Tankou Li, North Dist., Taichung, Taiwan

[21] Appl. No.: 432,591

[22] Filed: May 1, 1995

[51] Int. Cl.[6] ..... B41F 19/02

[52] U.S. Cl. ..... 101/23; 101/33; 101/131.5

[58] Field of Search ..... 101/33, 34, 32, 101/22, 23, 132, 131, 131.5, 488, 6, 25

[56] References Cited

U.S. PATENT DOCUMENTS

| | | | |
|---|---|---|---|
| 1,514,450 | 11/1924 | Ervin | 101/22 |
| 2,252,704 | 8/1941 | Davies | 101/22 |
| 2,442,598 | 6/1948 | Harrison et al. | 101/22 |
| 2,446,771 | 8/1948 | Knowland | 101/32 |
| 2,756,669 | 7/1956 | Hoffman | 101/25 |
| 2,947,058 | 8/1960 | Landells et al. | 101/32 |
| 3,162,561 | 12/1964 | Farkas | 101/32 |
| 3,874,846 | 4/1975 | Ashe | 101/32 |
| 4,340,438 | 7/1982 | Davis | 101/25 |
| 4,779,437 | 10/1988 | Kubiak | 101/22 |

*Primary Examiner*—Edgar S. Burr
*Assistant Examiner*—Anthony H. Nguyen
*Attorney, Agent, or Firm*—Merchant, Gould, Smith, Edell, Welter & Schmidt

[57] ABSTRACT

A stamping machine includes a casing on which a press-printing assembly is mounted which included a heated pressing cylinder and a gripper member with a gap defined therebetween. A first conversion member with a first pattern releasably formed thereon is displaced to extend through the gap. A second conversion member with a second pattern releasably formed thereon is displaced to extend through the gap. A guiding member is provided for introducing the workpiece into the gap to be urged and pressed between the first and second conversion members such that the first and second patterns on the first and second conversion members are respectively printed on the top and bottom faces of the workpiece.

7 Claims, 6 Drawing Sheets

STAMPING MACHINE FOR PRINTING PATTERNS ON A BLIND SLAT AND A METHOD USING SUCH A MACHINE

BACKGROUND OF THE INVENTION

1. Field of Invention

The present invention relates to a stamping machine and a method thereof, and more particularly to a stamping machine for printing patterns onto a blind slat and the like and a method using such a machine.

2. Related Prior Art

Usually, a Venetian blind includes a plurality of slats each of which is stuck with different patterns, colors or figures thereon which are easily detached from the slats during long-term utilization.

The present invention has arisen to mitigate and/or obviate disadvantages of the conventional arrangement for sticking patterns on the Venetian blind.

SUMMARY OF THE INVENTION

In accordance with one aspect of the present invention, there is provided a stamping machine for printing patterns onto a workpiece which includes a top face and a bottom face. The stamping machine comprises a casing having a first side, a second side and a top portion with a first end adjacent to the first side and a second end adjacent to the second side. A first base is formed on the first end of the top portion of the casing and includes a first roller group mounted thereon. A second base is formed on the second end of the top portion of the casing and includes a first driving roller mounted thereon. A third base is formed on the first side of the casing beneath the first base and includes a second roller group mounted thereon. A fourth base is formed on the second side of the casing beneath the second base and includes a second driving roller mounted thereon.

A press-printing assembly is mounted on a mediate portion of the top portion of the casing and includes a heated pressing cylinder and a gripper member with a gap defined therebetween. A first conversion member with a first pattern releasably formed thereon includes a first end stretched on the first roller group, a second end mounted around the first driving roller and a mediate portion extending through the gap between the heated pressing cylinder and the gripper member. A second conversion member with a second pattern releasably formed thereon includes a first end stretched on the second roller group, a second end mounted around the second driving roller and a mediate portion extending through the gap between the heated pressing cylinder and the gripper member. A guiding member is mounted on the first base for introducing the workpiece into the gap to be urged and pressed between the first and second conversion members such that the first and second patterns on the first and second conversion members are respectively printed on the top and bottom faces of the workpiece.

In accordance with another aspect of the present invention, there is provided a method comprising the steps of (a) providing and stretching a first conversion member with a first pattern releasably formed thereon; (b) providing and stretching a second conversion member with a second pattern releasably formed thereon; (c) providing a press-printing assembly which includes a gripper member and a heated pressing cylinder with a gap defined therebetween; (d) displacing the first conversion member to continuously extend through the gap and urge between the gripper member and the heated pressing cylinder; (e) displacing the second conversion member to continuously extend through the gap and urge between the gripper member and the heated pressing cylinder; (f) displacing the workpiece to be continuously pressed through the gap between the first and second conversion members such that the first and second patterns on the first and second conversion members are respectively printed onto the top and bottom faces of the workpiece.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
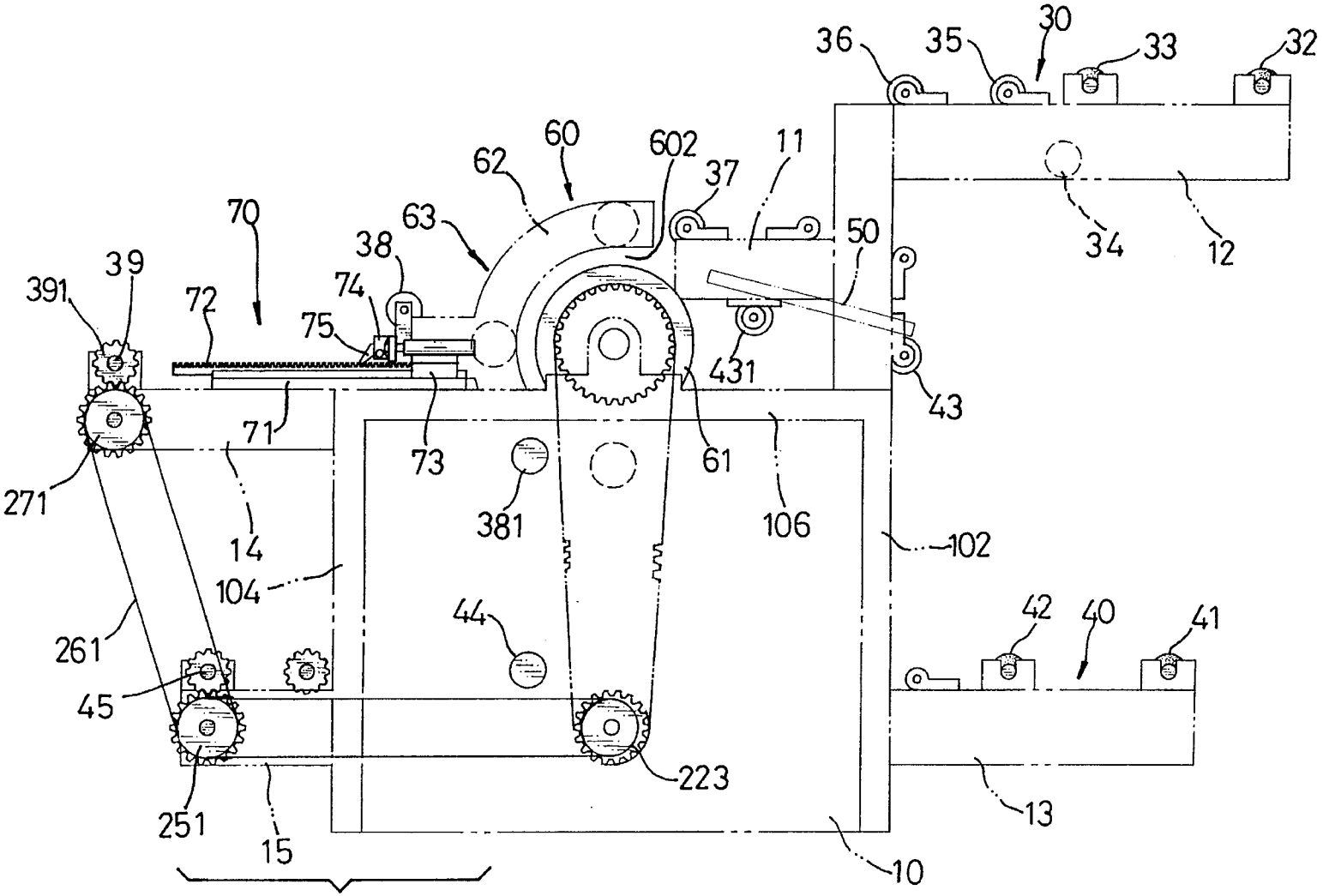
FIG. 1 is a front plan view of a stamping machine in accordance with the present invention.
Figure 2:
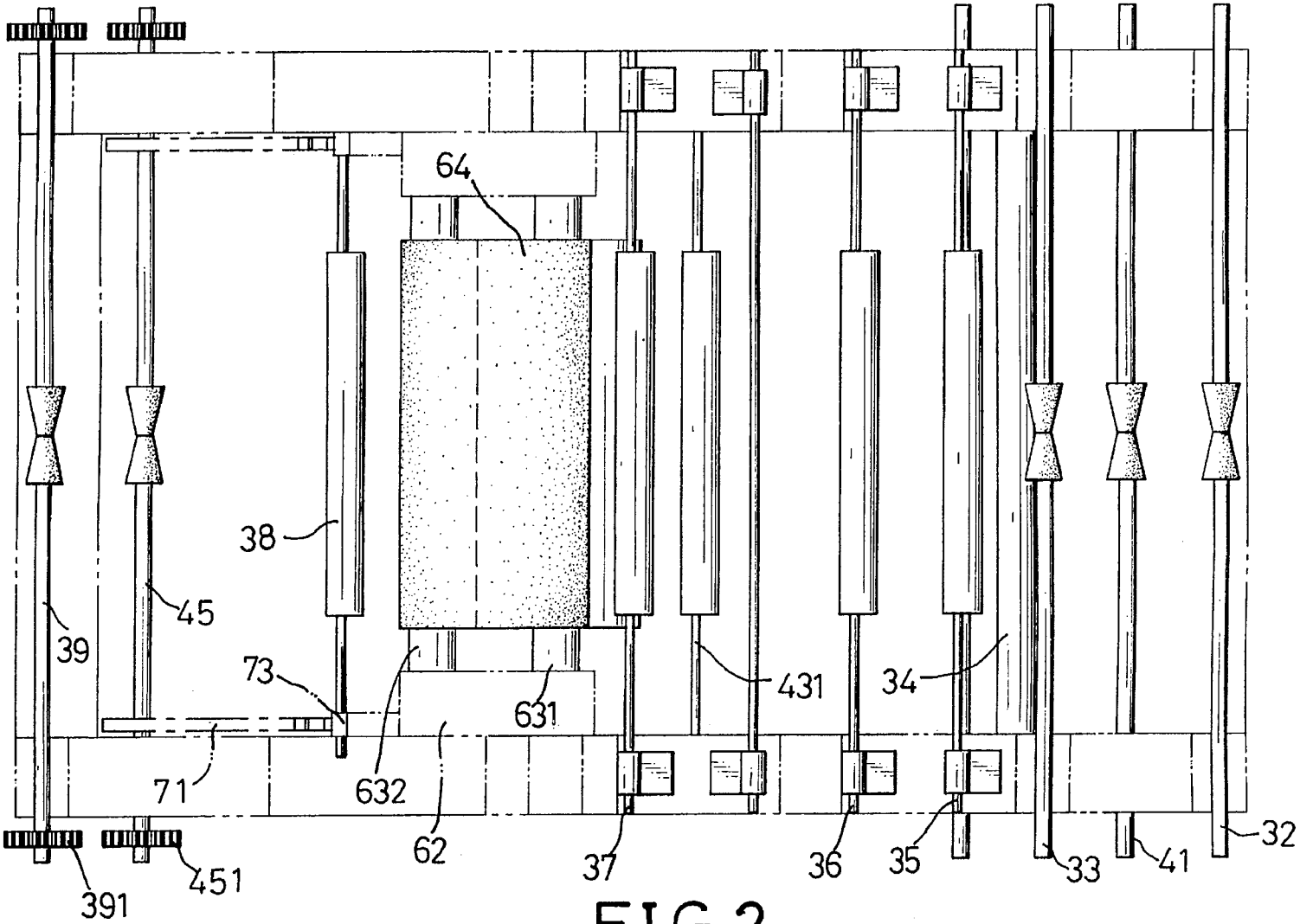
FIG. 2 is a top plan view of FIG. 1.
Figure 3:
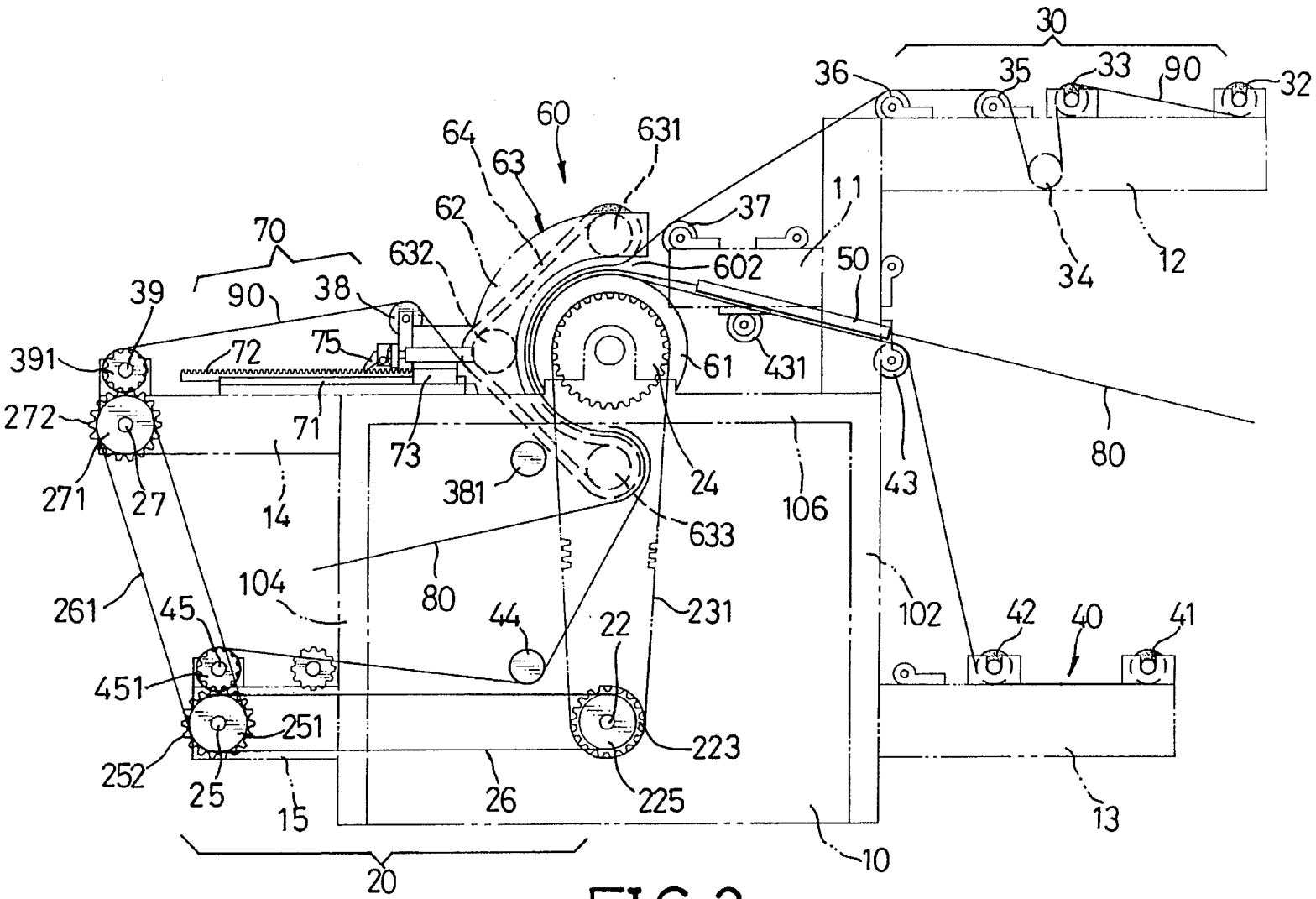
FIG. 3 is a front plan operational view of FIG. 1.

Referring to the drawings, and initially to FIGS. 1–3, a stamping machine in accordance with the present invention is provided for printing different patterns, figures or colors onto a plurality of workpieces 80 such as blind slats such that each of the workpieces 80 are fitted and decorated with patterns on double faces thereof.

The stamping machine comprises a casing 10 having a first side 102, a second side 104 and a top portion 106 with a first end adjacent to the first side 102 and a second end adjacent to the second side 104. A substantially L-shaped first base 12 is formed on the first end of the top portion 106 of the casing 10 and includes a first roller group 30 mounted thereon. The first roller group 30 includes four rollers 32, 33, 35 mounted on a top portion of the first base 12 and 36 and a stretching roller 34 mounted on a lower portion thereof between rollers 33 and 35. A second base 14 is formed on the second end of the top portion 106 of the casing 10 and protrudes outwardly therefrom and includes a first driving roller 39 mounted thereon.

A third base 13 is formed on the first side 102 of the casing 10 beneath the first base 12 and includes a second roller group 40 mounted thereon which includes rollers 41 and 42. A fourth base 15 is formed on the second side 104 of the casing 10 beneath the second base 14 and includes a second driving roller 45 mounted thereon. A support base 11 is attached to the first base 12 and includes rollers 37 and 431 respectively mounted on top and bottom portions thereof. Preferably, the bases 11, 14, 13 and 15 all are formed by two parallel beams with a space defined therebetween and the base 12 is formed by two parallel L-shaped beams with a space defined therebetween.

A press-printing assembly 60 is mounted on a mediate portion of the top portion 106 of the casing 10 and includes a heated pressing cylinder 61 and a gripper member 63 with a gap 602 defined therebetween. A roller 38 is mounted on the gripper member 63 of the press-printing assembly 60 and rollers 381 and 44 are mounted in the casing 10 beneath the press-printing assembly 60. A guiding plate 50 is mounted on the first base-12 in a tilting manner and a roller 43 is mounted on an underside of the guiding plate 50.

Particularly referring to FIGS. 3 and 4, a first conversion member 90, such as a cloth or a sheet of paper, with a first pattern 902 releasably formed thereon is stretched between the roller 32 and the first driving roller 39 and initially extends through rollers 32, 33, 34, 35, 36, 37, then passes through the gap 602 between the heated pressing cylinder 61 and the gripper member 63, subsequently extends through rollers 381 and 38 and finally wraps around the first driving roller 39 to rotate therewith.

In a same manner, a second conversion member 91 with a second pattern 912 releasably formed thereon is stretched between the roller 41 and the second driving roller 45 and initially extends through rollers 41, 42, 43, 431, then passes through the gap 602 between the heated pressing cylinder 61 and the gripper member 63, subsequently extends through roller 44 and finally wraps around the second driving roller 45 to rotate therewith.

Figure 8:
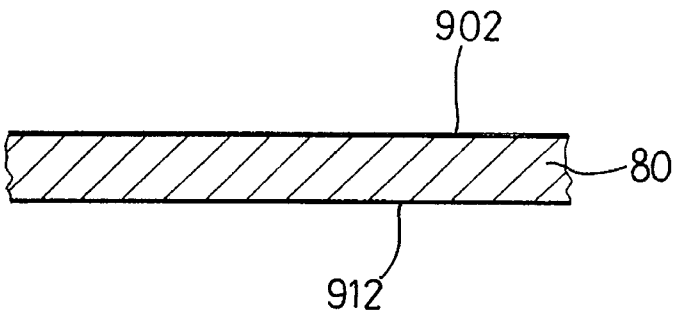
FIG. 8 is an assembly view of a workpiece printed with different patterns.

The workpiece 80 is introduced by means of the guiding plate 50 into the gap 602 to be urged and pressed between the first and second conversion members 90 and 91 such that by means of heating and pressing action between the heated pressing cylinder 61 and the gripper member 63 the first and second patterns 902 and 912 on the first and second conversion members 90 and 91 are able to be respectively printed on the top and bottom faces of the workpiece 80 as best shown in FIG. 8.

Figure 4:
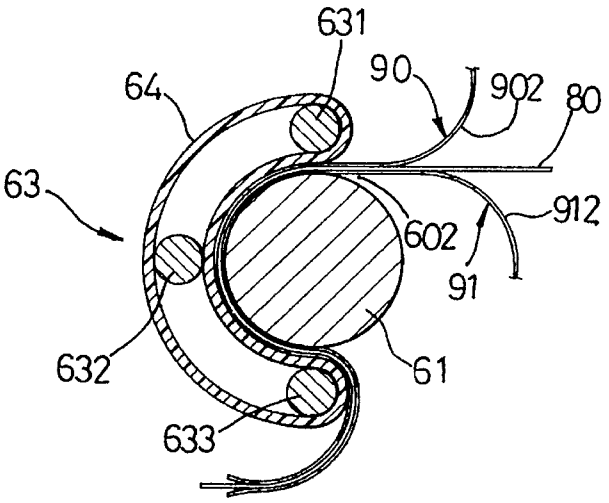
FIG. 4 is an enlarged cross-sectional view of a press-printing assembly.
Figure 5:
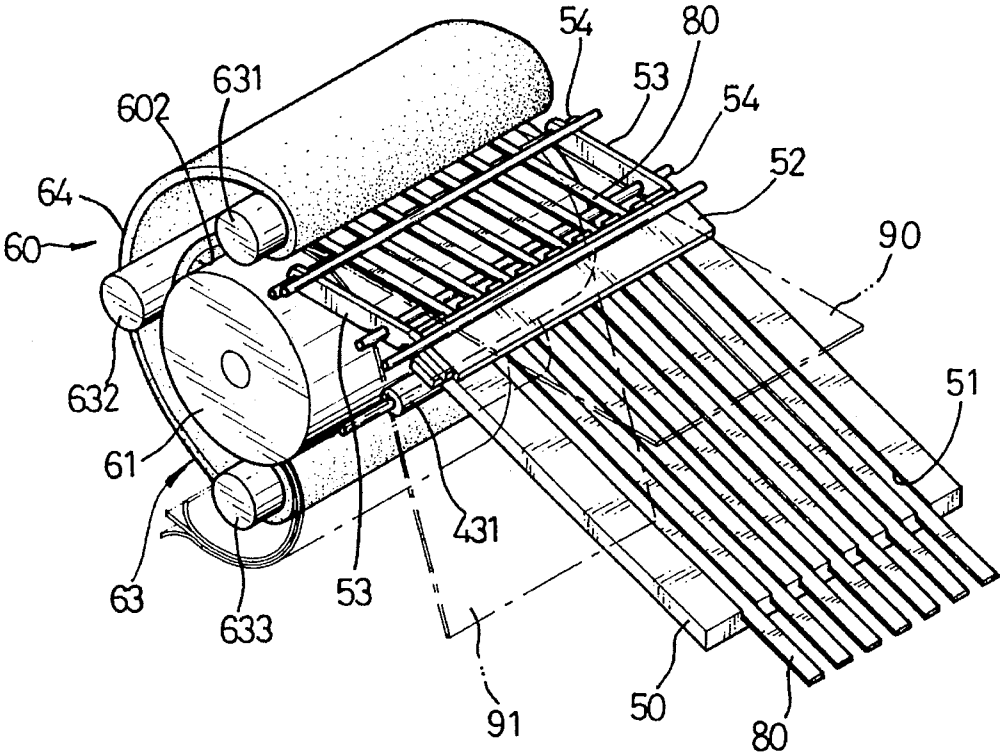
FIG. 5 is a perspective view of the press-printing assembly on combination with a guiding plate.

Referring to FIGS. 3–5, the gripper member 63 includes a substantially C-shaped housing 62 slidably mounted on the top portion 106 of the casing 10. Preferably, the C-shaped housing 62 is formed by two parallel C-shaped members with a distance defined therebetween. An upper roller 631, a mediate roller 632 and a lower roller 633 are respectively mounted in the C-shaped housing 62 and an endless fabric 64 is rotatably mounted around the upper, mediate and lower rollers 631, 632 and 633 and is located adjacent to the heated pressing cylinder 61.

Figure 7:
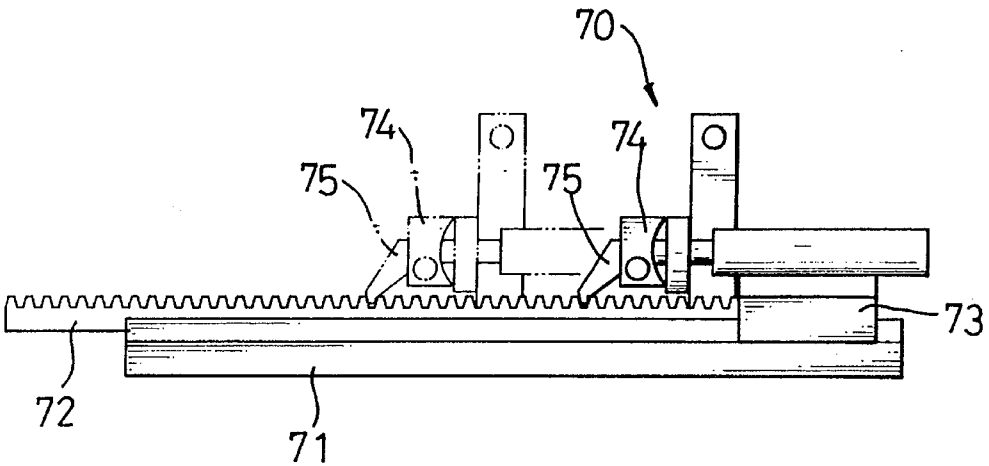
FIG. 7 is a front plan view of an adjusting assembly.

Referring to FIG. 7 with reference to FIG. 3, an adjusting assembly 70 is provided for displacing the C-shaped housing 62 relative to the heated pressing cylinder 61 and includes an elongated block 71 mounted on the top portion 106 of the casing 10. A rack 72 is fixedly mounted on the elongated block 71. A sliding member 73 is connected with a mediate portion of the C-shaped housing 62 and is slidably engaged on the elongated block 71. A pivot base 74 is securely mounted on the sliding member 73, and a pawl 75 has a first end pivotally mounted on the pivot base 74 and a second end detachably engaged on the rack 72.

By such an arrangement, when the second end of the pawl 75 is detached from the rack 72, the sliding member 73 is able to slide on the block 71, thereby displacing the C-shaped housing 62 relative to the heated pressing cylinder 61 so as to adjust a relative position between the endless fabric 64 and the heated pressing cylinder 61.

Referring to FIG. 5, a plurality of parallel guiding tracks 51 are defined in the guiding plate 50 and a retaining plate 52 is fixedly mounted on a top portion of the guiding plate 50. Two parallel supporting rods 54 each have two distal ends each of which is securely attached to a corresponding fastening member 53 which is secured to the guiding plate 50. By such an arrangement, a plurality of workpieces 80 such as blind slats are able to slide in the guiding tracks 51, then pass through an underside of the retaining plate 52, subsequently extend through the two supporting rods 54 and are finally introduced and pressed into the gap 602 between the endless fabric 64 and the heated pressing cylinder 61.

Figure 6:
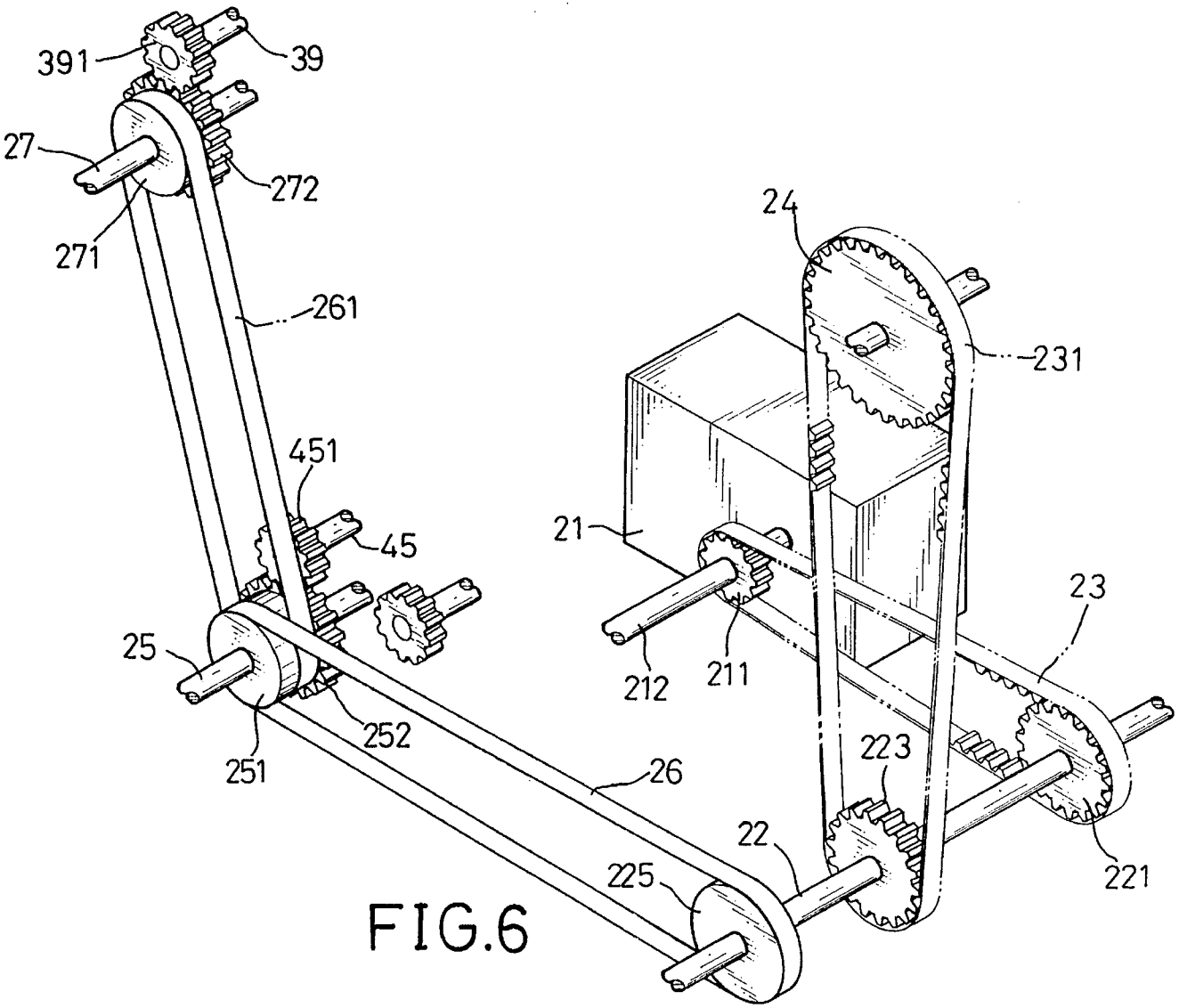
FIG. 6 is a perspective view showing a transmission mechanism.

Referring to FIG. 6 with reference to FIG. 3, a transmission mechanism 20 is provided for rotating the first driving roller 39, the second driving roller 45 and the heated pressing cylinder 61. The transmission mechanism 20 includes a power supply 21 mounted in the casing 10 and having a spindle 212 projecting outwardly therefrom. A driving sprocket 211 is fixedly mounted around the spindle 212 to rotate therewith. A shaft 22 is rotatably mounted in the casing 10 and has a first end and a second end. A driven sprocket 221 is fixedly mounted around the first end of the shaft 22 and a primary toothed belt 23 meshes with the driving and driven sprockets 211 and 221 such that the driving and driven sprockets 211 and 221 are rotated in concert.

A first transmission sprocket 223 is fixedly mounted around a mediate portion of the shaft 22, a second transmission sprocket 24 is fixedly connected with the heated pressing cylinder 61, and an auxiliary toothed belt 231 meshes with the first and second transmission sprockets 223 and 24 such that the first and second transmission sprockets 223 and 24 are rotated in concert.

An axle 25 is rotatably mounted on the fourth base 15. A driving wheel 225 is fixedly mounted around the second end of the shaft 22, a driven wheel 251 is fixedly mounted around the axle 25, and a primary flat belt 26 is mounted around the driving and driven wheels 225 and 251 for rotating the driving and driven wheels 225 and 251 in concert. A first gear 252 is fixedly mounted around the axle 25, and a second gear 451 is fixedly mounted around the second driving roller 45 and meshes with the first gear 252 so as to rotate the second driving roller 45 by means of the first gear 252.

An axle 27 is rotatably mounted on the second base 14, a transmission wheel 271 is fixedly mounted around the axle 27, and an auxiliary flat belt 261 is mounted around the driven and transmission wheels 251 and 271 for rotating the driven and transmission wheels 251 and 271 in concert. A third gear 272 is fixedly mounted around the axle 27, and a fourth gear 391 is fixedly mounted around the first driving roller 39 and meshes with the third gear 272 so as to rotate the first driving roller 39 by means of the third gear 272.

By such an arrangement, the spindle 212 together with the sprocket 211 is actuated to rotate by the power supply 21, thereby rotating the sprocket 221 together with the shaft 22 via the chain 23. The sprocket 223 is then actuated by the shaft 22 to rotate the sprocket 24 via the chain 231, thereby driving the heated pressing cylinder 61 to rotate.

The wheel 225 is also actuated by the shaft 22 to rotate the wheel 251 via the flat belt 26, thereby rotating the gear 252 which in turn rotates the gear 451 so as to drive the second driving roller 45 to rotate such that the second conversion member 91 is able to continuously move forward by means of the second driving roller 45.

The wheel 271 is actuated to rotate by the wheel 251 via the flat belt 261, thereby rotating the gear 272 which in turn rotates the gear 391 so as to drive the first driving roller 39 to rotate such that the second conversion member 91 is able to continuously move forward by means of the first driving roller 39.

In operation, the first and second conversion members 90 and 91 are actuated to displace forward respectively by means of first and second driving rollers 39 and 45 such that the first conversion member 90 is stretched between rollers 32 and 39 and the second conversion member 91 is stretched between rollers 41 and 45. The plurality of workpieces 80 are then introduced by the guiding plate 50 into the gap 602 to be urged between the first and second conversion members 90 and 91 and is heated and pressed between the endless fabric 64 of the gripper member 63 and the rotatable heated pressing cylinder 61 such that first and second patterns 902 and 912 of the first and second conversion members 90 and 91 are respectively printed on top and bottom faces of the workpieces 80 (see FIG. 8). Finally, the workpieces 80 coated with first and second patterns 902 and 912 are drawn away from the gap 602 between the endless fabric 64 and the heated pressing cylinder 61 to be stocked by a collector (not shown), thereby accomplishing the stamping process.

It should be clear to those skilled in the art that further embodiments of the present invention may be made without departing from the teachings of the present invention.

I claim:

1. A stamping machine for printing patterns onto a workpiece (80) which includes a top face and a bottom face, said stamping machine comprising:

a casing (10) having a first side (102), a second side (104) and a top portion (106) with a first end adjacent to the first side (102) and a second end adjacent to the second side (104);

a first base (12) formed on the first end of the top portion (106) of said casing (10) and including a first roller group (30) mounted thereon;

a second base (14) formed on the second end of the top portion (106) of said casing (10) and including a first driving roller (39) mounted thereon;

a third base (13) formed on the first side (102) of said casing (10) beneath said first base (12) and including a second roller group (40) mounted thereon;

a fourth base (15) formed on the second side (104) of said casing (10) beneath said second base (14) and including a second driving roller (45) mounted thereon;

a press-printing assembly (60) mounted on a mediate portion of the top portion (106) of said casing (10) and including a heated pressing cylinder (61) and a gripper member (63) with a gap (602) defined therebetween;

a first conversion member (90) with a first pattern releasably formed thereon having a first end stretched on said first roller group (30), a second end mounted around said first driving roller (39) and a mediate portion extending through said gap (602) between said heated pressing cylinder (61) and said gripper member (63);

a second conversion member (91) with a second pattern releasably formed thereon having a first end stretched on said second roller group (40), a second end mounted around said second driving roller (45) and a mediate portion extending through said gap (602) between said heated pressing cylinder (61) and said gripper member (63); and a guiding member (50) mounted on said first base (12) for introducing said workpiece (80) into said gap (602) to be urged and pressed between said first and second conversion members (90) and (91) such that said first and second patterns on said first and second conversion members (90) and (91) are respectively printed on the top and bottom faces of said workpiece (80).

2. The stamping machine in accordance with claim 1, further comprising a transmission mechanism (20) mounted in said casing (10) for rotating said first driving roller (39), said second driving roller (45) and said heated pressing cylinder (61), said transmission mechanism (20) including a power supply (21) having a spindle (212) projecting outwardly therefrom, a driving sprocket (211) fixedly mounted around said spindle (212) to rotate therewith, a shaft (22) rotatably mounted in said casing (10) and having a first end and a second end, a driven sprocket (221) fixedly mounted around the first end of said shaft (22) to rotate therewith, a primary toothed belt (23) meshing with said driving and driven sprockets (211) and (221), a first transmission sprocket (223) fixedly mounted around a mediate portion of said shaft (22), a second transmission sprocket (24) fixedly connected with said heated pressing cylinder (61), and an auxiliary toothed belt (231) meshing with said first and second transmission sprockets (223) and (24).

3. The stamping machine in accordance with claim 2, further comprising an axle (25) rotatably mounted on said fourth base (15), a driving wheel (225) fixedly mounted around the second end of said shaft (22), a driven wheel (251) fixedly mounted around said axle (25), a primary flat belt (26) mounted around said driving and driven wheels (225) and (251) for rotating said driving and driven wheels (225) and (251) in concert, a first gear (252) fixedly mounted around said axle (25), and a second gear (451) fixedly mounted around said second driving roller (45) and meshing with said first gear (252).

4. The stamping machine in accordance with claim 3, further comprising an axle (27) rotatably mounted on said second base (14), a transmission wheel (271) fixedly mounted around said axle (27), an auxiliary flat belt (261) mounted around said driven and transmission wheels (251) and (271) for rotating said driven and transmission wheels (251) and (271) in concert, a third gear (272) fixedly mounted around said axle (27), and a fourth gear (391) fixedly mounted around said first driving roller (39) and meshing with said third gear (272).

5. The stamping machine in accordance with claim 1, wherein said gripper member (63) includes a substantially C-shaped housing (62) slidably mounted on the top portion (106) of said casing (10), an upper roller (631), a mediate roller (632) and a lower roller (633) respectively mounted in said C-shaped housing (62), an endless fabric (64) rotatably mounted around said upper, mediate and lower rollers (631), (632) and (633) and located adjacent to said heated pressing cylinder (61).

6. The stamping machine in accordance with claim 5, further comprising an adjusting assembly (70) having an elongated block (71) mounted on the top portion (106) of said casing (10), a rack (72) mounted on said elongated block (71), a sliding member (73) connected with a mediate portion of said C-shaped housing (62) and slidably engaged on said elongated block (71), a pivot base (74) mounted on said sliding member (73), and a pawl (75) having a first end pivotally mounted on said pivot base (74) and a second end detachably engaged on said rack (72).

7. A method for printing patterns onto a workpiece (80) which has a top face and a bottom face, said method comprising the steps of:

(a) providing and stretching a first conversion member (90) with a first pattern releasably formed thereon;

(b) providing and stretching a second conversion member (91) with a second pattern releasably formed thereon;

(c) providing a press-printing assembly (60) which includes a gripper member (63) and a heated pressing cylinder (61) with a gap (602) defined therebetween;

(d) displacing said first conversion member (90) to continuously extend through said gap (602) and urge between said gripper member (63) and said heated pressing cylinder (61);

(e) displacing said second conversion member (91) to continuously extend through said gap (602) and urge between said gripper member (63) and said heated pressing cylinder (61); and (f) displacing said workpiece (80) to be continuously pressed through said gap (602) between said first and second conversion members (90) and (91) such that the first and second patterns on said first and second conversion members (90) and (91) are respectively printed onto the top and bottom faces of said workpiece (80).

* * * * *